United States Patent [19]

Miller

[11] Patent Number: 4,966,056

[45] Date of Patent: Oct. 30, 1990

[54] HAND-HELD STAPLE HOLDER

[75] Inventor: Glenn Miller, Lewisburg, Pa.

[73] Assignee: Lemco Tool Corporation, Cogan Station, Pa.

[21] Appl. No.: 446,208

[22] Filed: Dec. 4, 1989

[51] Int. Cl.[5] ..... B25C 3/00

[52] U.S. Cl. ..... 81/44; 227/135

[58] Field of Search ..... 81/44; 173/90; 227/135, 227/156

[56] References Cited

U.S. PATENT DOCUMENTS

| | | | |
|---|---|---|---|
| D. 293,648 | 1/1988 | Smirne . | |
| 379,898 | 3/1888 | Lewis | 81/44 |
| 2,009,580 | 7/1935 | Govanus . | |
| 2,127,665 | 8/1938 | Leslie . | |
| 2,637,030 | 5/1953 | Wickman et al. . | |
| 3,080,564 | 3/1963 | Strekopitov et al. . | |
| 3,165,968 | 1/1965 | Anstett . | |
| 3,238,983 | 3/1966 | Abrahamsen . | |
| 3,294,303 | 12/1966 | Anstett . | |
| 3,846,900 | 11/1974 | Weglage . | |
| 3,883,064 | 5/1975 | Hilgers . | |
| 4,326,661 | 4/1982 | Maurer et al. . | |
| 4,378,065 | 3/1983 | Smirne . | |

FOREIGN PATENT DOCUMENTS

| | | | |
|---|---|---|---|
| 1159868 | 12/1963 | Fed. Rep. of Germany | 81/44 |
| 2403851 | 8/1975 | Fed. Rep. of Germany | 81/44 |
| 5414 | 3/1893 | United Kingdom | 81/44 |

*Primary Examiner*—James G. Smith

*Attorney, Agent, or Firm*—Ferrill and Logan

[57] ABSTRACT

A hand-held mechanism for holding staples. The invention comprises a flexible member having a substantially flat main section and at least one handle extending therefrom. The main section has a plurality of first slots for holding staples, the slots extending at an angle to facilitate the placement and attachment of the staples. The invention further comprises a plurality of second slots interspersed to either hold different sized staples or aid in aligning the first slots with the workpiece.

9 Claims, 3 Drawing Sheets

HAND-HELD STAPLE HOLDER

FIELD OF THE INVENTION

The present invention is directed to an implement for holding and supplying staples to a work location. Specifically, the present invention is directed to a staple holder which is less complex and lighter than prior art staple holders and which affords a greater degree of safety to the workman applying the staples to a work location.

BACKGROUND OF THE INVENTION

The present invention relates to a staple holder. In particular the present invention is directed to a hand-held staple holder for holding staples to be driven into a workpiece such as a utility pole.

In the outside aerial plant of a cable TV system, for example, amplifiers and other electronic equipment must be spliced with the cable. These devices are protected from lightning via No. 6 copper ground wires which are stapled to utility poles. At the base of each pole, a ground wire is attached to a ground rod which is driven into the earth beside the pole.

After the ground wire is attached to the respective electronic equipment, a lineman begins the process of stapling the ground wire from the top to bottom of the pole. The supply of staples is typically carried in a canvas pouch attached to the lineman's belt. Linemen typically wear gloves because utility poles have sharp, jagged edges and lead to splinters, cuts and injuries to ungloved hands. The heavy protective gloves make it difficult to reach into the staple pouch to locate individual staples. Removing the glove to find a staple can result in the point of a staple becoming lodged under a fingernail. Glove replacement and removal is also time-consuming.

Once the small staple is located, the lineman positions it over the ground wire and against the pole so as to hammer it into the pole. A gloved hand holding the staple provides minimal free space for the hammer to strike and a workman may frequently hit his hand with the hammer. Moreover, a hand-held staple will frequently be mis-hit, resulting in flying shrapnel. Further, the traditional hand-held procedure for installing staples frequently results in bent staples which cannot be corrected and must be withdrawn from the pole and thrown away. In order to avoid injury, the workmen will typically hold the staple with a pair of pliers which is time consuming.

There have been numerous devices created to drive staples into a workpiece. U.S. Pat. Nos. 2,127,665, and 3,294,303 disclose various staple attachment implements. None of these approaches is suitable for handling large staples such as required, for example, by cable-TV and utility companies.

U.S. Pat. No. 4,378,065 discloses an apparatus for holding and attaching large staples to a workpiece such as a utility pole. Unfortunately, the staple holding apparatus disclosed therein is relatively complex and heavy. Further, the staple holder disclosed in U.S. Pat. No. 4,378,065 can only hold ten staples having a single size and the staples must frequently be reloaded.

It would be desirable to provide a hand-held staple mechanism which can be utilized to hold and align staples having varying dimensions for application in power lines and the like.

It would further be desirable to provide a hand-held staple mechanism which is light in weight and which can be easily held and maneuvered by a workman.

It is therefore an object of the present invention to provide a staple holder which is light, inexpensive and easy to position, and which facilitates the safe application of large staples of varying dimensions to a workpiece such as a utility pole.

The present invention is specifically directed to a portable hand-operated staple holder, such as used by electric power linemen for supplying staples to a work location where they may be driven into a pole or post.

SUMMARY OF THE INVENTION

A hand-held mechanism for holding and supporting staples comprising a flexible member having a substantially flat main section and at least one handle extending therefrom; said main section having a plurality of first slots for holding staples having a first size, said slots being beveled to facilitate the driving of said staples into a work piece by a workman; and a plurality of second slots interspersed between the first slots and which hold staples having a second size.

BRIEF DESCRIPTION OF THE DRAWINGS

The foregoing summary, as well as the following detailed description will be better understood when read in conjunction with the figures appended hereto. For the purpose of illustrating the invention, there is shown in the drawings an embodiment which is presently preferred, it being understood, however, that this invention is not limited to the precise arrangement and instrumentalities shown.

DETAILED DESCRIPTION OF THE PRESENT INVENTION

Figure 1:
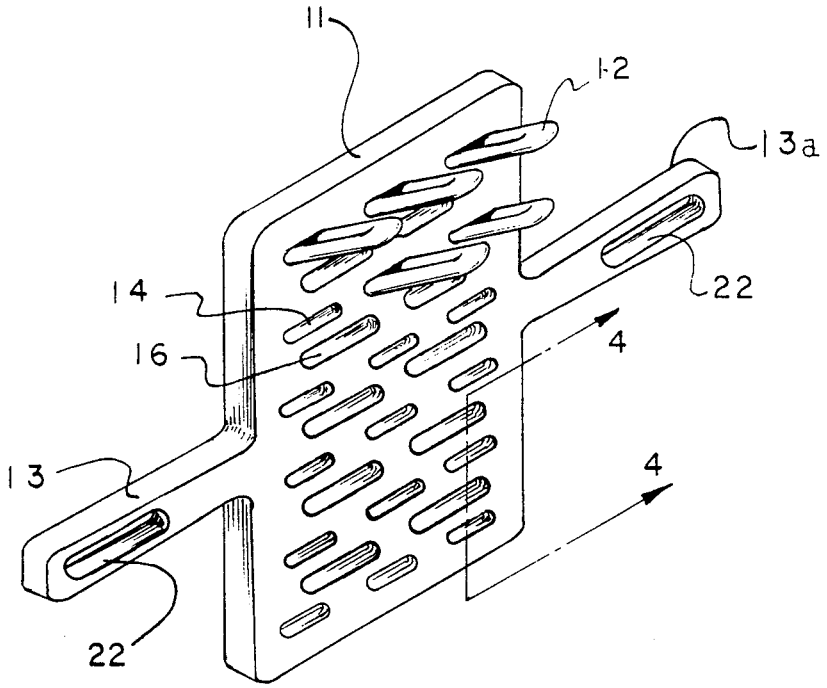
FIG. 1 is an isometric view of the staple holder of the preferred embodiments.
Figure 2:
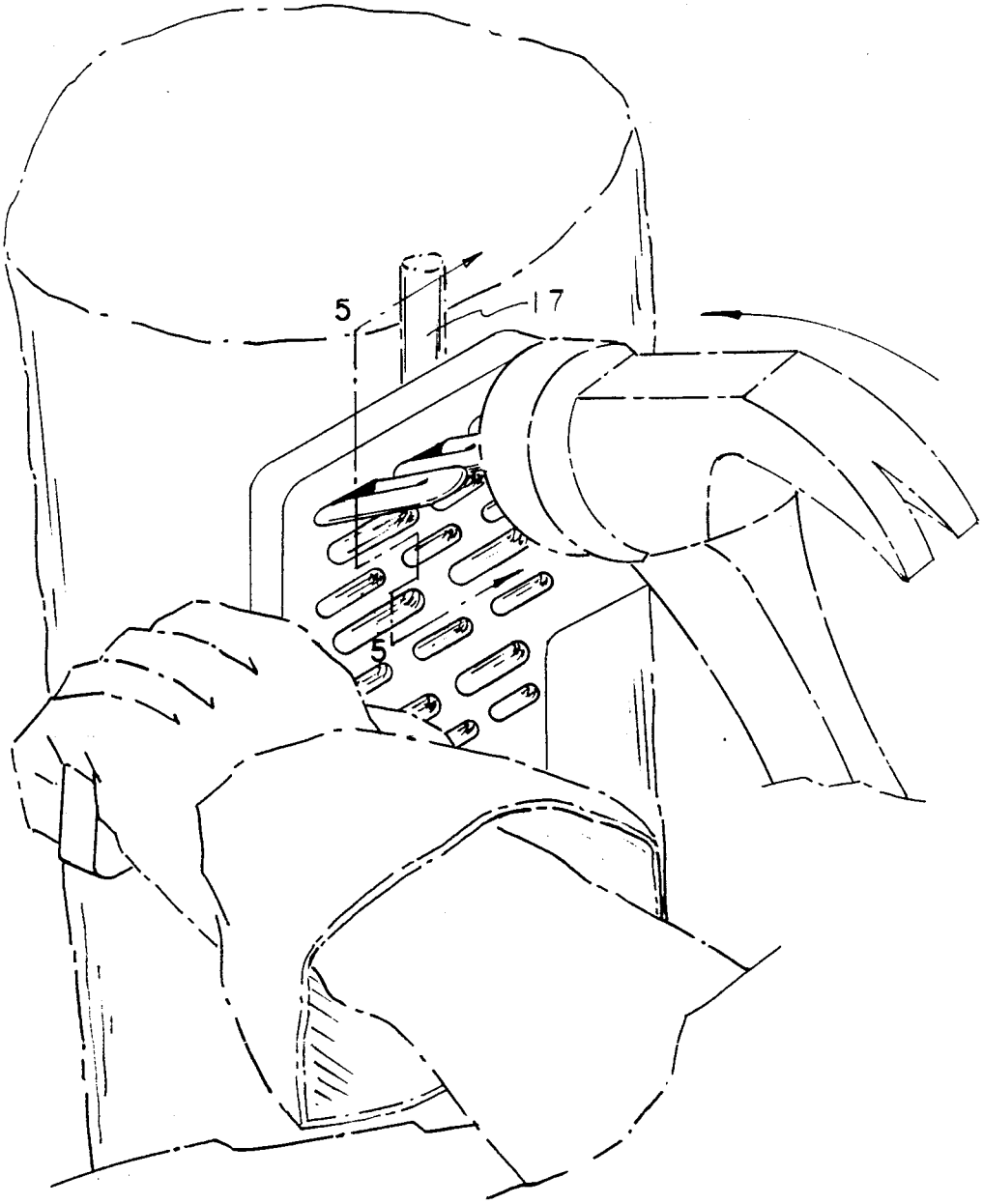
FIG. 2 is a perspective view of the staple holder of the preferred embodiment being utilized by a workman.
Figure 3A:
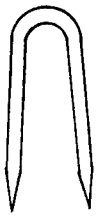
FIG. 3A is a perspective view of a staple having a second size which can be placed in the alignment slots.
Figure 3:
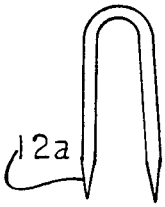
FIG. 3 is perspective view of a staple which can be utilized with the staple holder of the preferred embodiment.
Figure 3B:
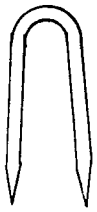
FIG. 3B is a perspective view of a staple having a third size for placement in the handle slot.

The present invention is disclosed and described with reference to the enclosed figures wherein the same numbers are utilized where applicable. Referring to FIGS. 1 and 2, the hand-held staple support 10 of the present invention is shown. The hand-held support comprises a flat rectangular body 11 which holds a quantity of staples 12. The flat rectangular body 11 is constructed from a plastic or other durable material and may either be flexible or rigid. The rectangular body has two handles 13, **13*a* which extend out opposite sides of the body. The staples 12 may have any dimension but the present invention is specifically designed to be utilized to drive the large industrial staples utilized by electric and telephone utilities. As shown in FIG. 3, the staples are characterized by non-parallel ends 12*a***, accordingly assume a V-shaped form and are approximately 1.5 inches in length.

Figure 4:
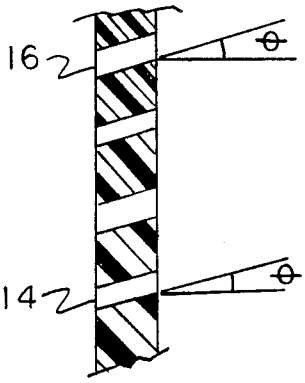
FIG. 4 is a section view of the staple holder of the preferred embodiment along line 4—4 of FIG. 1.

The staples 12 are aligned in a parallel configuration within beveled or angled slots 14 which extend along the body 11. As shown in FIG. 4, slots should be beveled at an angle of between 15° and 30° relative to the plane extending perpendicular to the surface of body member 11.

Figure 5:
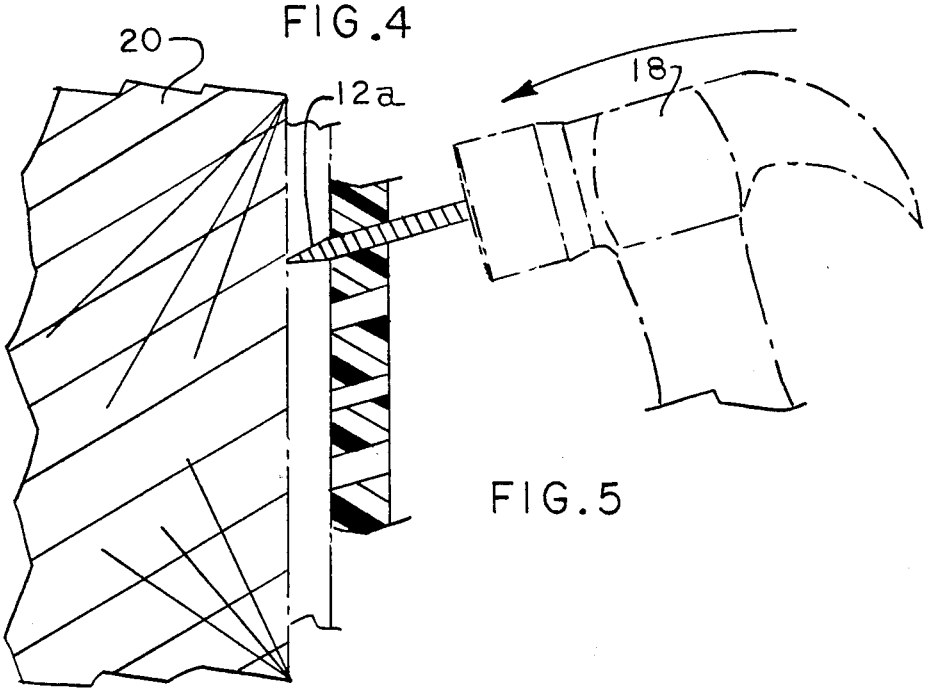
FIG. 5 is a section view of the staple holder of the preferred embodiment along line 5—5 of FIG. 2.

Referring to FIGS. 4 and 5, slots 16 (See FIG. 1) are interspersed between slots 14. The additional slots 16 FIG. 3A) hold staples having different dimensions than the approximate 1.5 inch staples shown in FIG. 3, and when not used to hold staples, facilitate the alignment of the staples with the workpiece. As with slots 14 slots 16 are similarly beveled at an angle $\theta$ of between 15° and 30° relative to the plane extending perpendicular to the surface of body member 11.

In operation, the hand-held staple holder may, for example, be utilized by a utility lineman who would initially fill the staple holder slots (14 or 16 or both) with staples. The staple holder is filled by placing the staples, sharp end first 12*a*, through the individual slots 14 so that the sharp ends minimally extend out the other side of the support member, as shown in FIG. 4. If staples having larger dimensions are to be used, slots 16 would be filled with staples. The workman, grabbing one of the two handles, then sequentially moves up a line 17, and hammers in the staples with a hammer 18 in a workpiece 20. As can be seen in FIGS. 2 and 5, the beveling of the staple slots 14, 16 aligns with the natural overhand hammering stroke of the operator and facilitates the attachment of the staples to a work member. The beveling thus minimizes the risk of bent staples, as well as sparks and flying shrapnel. If extremely large staples are required, handles 13, 13*a* have slots 22. As with slots, 14 and 16, slots 22 are beveled at an angle of between 15° and 30° relative to the plane extending perpendicular to the surface of body member 11.

It is to be appreciated by those skilled in the art that other embodiments fall within the spirit and scope of the present invention and that the true nature and scope of the present invention is to be determined with reference to the claims appended hereto. In particular, it is to be noted that while the present invention has been disclosed and described in the context of an application by a public utility or cable-TV company, the staple holder of the present invention can be utilized in numerous other applications.

What is claimed is:

1. A hand-held mechanism for holding and supporting staples comprising;

a member having a substantially flat main section and at least one handle extending therefrom, said main section having a plurality of slots for holding staples having a first size, said slots holding said staples at an angle relative to the surface of said main section so as to facilitate their attachment to a workpiece; and a plurality of second slots interspersed between said first slots for holding staples having a second size, said second slots holding said staples at an angle relative to the surface of said main section so as to facilitate their attachment to a workpiece.

2. The hand-held mechanism of claim 1 for holding and supporting staples wherein said main section has two handles extending therefrom.

3. The hand-held mechanism of claim 1 wherein said handle has a slot for holding staples having a third size, said handle slot holding said staples at an angle relative to the surface of the main section so as to facilitate their attachment to a workpiece.

4. The hand-held mechanism of claim 1 for holding and supporting staples wherein said main section is constructed from a polymer.

5. The hand-held mechanism of claim 1 wherein said main section is rigid.

6. The hand-held mechanism of claim 1 wherein said main section is flexible.

7. The hand-held mechanism for holding and supporting staples of claim 1 wherein said main section has a rectangular shape.

8. The hand-held mechanism for holding and supporting staples of claim 1 wherein first and second said slots are beveled at an angle of between 15° and 30° relative to the plane extending perpendicular to the surface of said main section.

9. The hand-held mechanism of claim 3 wherein said handle slot is beveled at an angle of between 15° and 30° relative to the plane extending perpendicular to the surface of said main section.

* * * * *